United States Patent [19]

Koontz

[11] 3,930,589

[45] Jan. 6, 1976

[54] PRY-OFF CLOSURE CAP

[75] Inventor: Carl E. Koontz, Thornville, Ohio

[73] Assignee: Anchor Hocking Corporation, Lancaster, Ohio

[22] Filed: Apr. 14, 1975

[21] Appl. No.: 567,483

Related U.S. Application Data

[63] Continuation of Ser. No. 394,967, Sept. 7, 1973, abandoned.

[52] U.S. Cl. ..... 215/352; 215/347; 215/349

[51] Int. Cl.[2] ..... B65D 53/00

[58] Field of Search ..... 215/341, 347, 349, 352

[56] References Cited

UNITED STATES PATENTS

| | | | |
|---|---|---|---|
| 978,634 | 12/1910 | Overmyer | 215/352 |
| 1,365,274 | 1/1921 | Rivers | 215/349 |
| 1,676,044 | 7/1928 | Olt | 215/349 |
| 1,755,168 | 4/1930 | Carhalko | 215/349 |
| 2,700,186 | 1/1955 | Stover | 215/352 |
| 3,272,369 | 9/1966 | Grimshey | 215/341 |
| 3,286,868 | 11/1966 | Mumford | 215/352 |
| 3,373,889 | 3/1968 | Giles | 215/352 |
| 3,445,023 | 5/1969 | Glessher | 215/352 |
| 3,460,701 | 8/1969 | Powalowski et al | 215/352 |

FOREIGN PATENTS OR APPLICATIONS

| | | | |
|---|---|---|---|
| 6,707,565 | 2/1968 | Netherlands | 215/349 |
| 570,926 | 7/1945 | United Kingdom | 215/352 |

*Primary Examiner*—George T. Hall

*Attorney, Agent, or Firm*—Holland, Armstrong, Wilkie & Previto

[57] ABSTRACT

An improved pry-off closure cap is described. The cap has a composite structure comprising a metal cover disc held in a molded plastic ring. The plastic ring has an inner groove for retaining the metal cover and container engaging means consisting of either spaced lugs or a continuous bead positioned on a depending skirt portion of the ring and positioned below the cover retaining groove.

7 Claims, 8 Drawing Figures

PRY-OFF CLOSURE CAP

This is a continuation of application Ser. No. 394,967 filed Sept. 7, 1973 now abandoned.

BACKGROUND OF THE INVENTION

The invention relates to an improved composite pry-off closure cap and more particularly to a pry-off cap which combines the advantages of a metal cover capable of providing a vacuum seal with an easily formed, attractive, and effective plastic ring for removably attaching the cap to a container. There are a number of prior closure caps which are retained on containers by spaced lugs or beads and which have a composite construction. These prior caps have various drawbacks including relatively complex container engaging ring portions, an overall unattractive appearance, high cost, or they have lacked the capacity for being attractively decorated with legends and other labeling matter.

The present closure cap provides a unique combination of a metal sealing disc held in sealing relationship with a container by an attractive, relatively simple and sure acting molded plastic ring.

The closure in accordance with the present invention is useful both for hermetic or vacuum seals as well as for sealing packages using safety seal liners formed of a relatively thick inner pulp board liner and an air-proof sealing membrane.

Accordingly, an object of the present invention is to provide an improved pry-off closure cap.

Another object of the invention is to provide an improved composite closure cap capable of forming vacuum seals.

Another object of the invention is to provide an improved closure cap having an effective and attractive molded plastic skirt portion.

Another object of the invention is to provide an improved easily manufactured pry-off closure cap of relatively low cost.

Another object of the invention is to provide a tamperproof composite closure cap.

Other and further objects of the invention will be apparent upon an understanding of the illustrative embodiment about to be described or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings, forming a part of the specification, wherein.

DESCRIPTION OF THE PREFERRED EMBODIMENT

Figure 3:
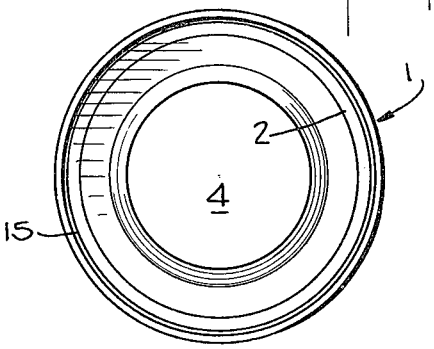
FIG. 3 is a horizontal sectional view of the sealed package taken along line 3—3 on FIG. 2.

The preferred embodiment will now be described with particular reference to FIGS. 1 through 3. These figures illustrate a closure cap 1 for sealing a glass or plastic or similar container 2 having a radially outwardly projecting bead 3 at the container rim. The closure cap 1 in accordance with the present invention is applied to and is placed in sealing engagement with the container 2 by being pressed downwardly onto the container 2. Thereafter, the closure cap 1 is removed by being pried off by the user using a pry-off hook.

The preferred embodiment of the closure cap 1 comprises a circular plate metal cover 4 contained in an outer plastic ring 5. The cover 4 preferably includes a depressed central stacking panel 6 and an outer, downwardly facing, gasket receiving channel 7. The channel 7 is defined by the sloping wall 8 of the stacking panel 6 and a depending outer skirt or wall portion 9 on the cover 4. A preferred form of a sealing gasket 10 is a flowed-in plastisol sealing gasket positioned in the channel 7 between the channel walls 8 and 9. The gasket 10 is positioned to form a hermetic seal with the upper rounded rim portion 11 of the container 2 in the manner illustrated in FIG. 2. The metal cover 4 includes an inner lacquer or other protective coating 12 which is inert with respect to the products to be packaged in the container.

The plastic ring 5 is preferably molded as a unitary piece with its several elements being shaped in the manner and for the purposes described below. The ring 5 is preferably molded of a plastic which provides dimensional stability together with a smooth surface appearance and a high resistance to impact or other possibly damaging treatment. Suitable plastics for this purpose include polystyrene, polyethylene, or similar impact resistant resins.

Figure 1:
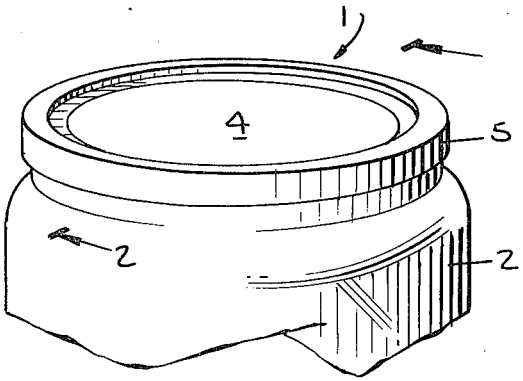
FIG. 1 is a perspective view of a package sealed by a closure in accordance with the present invention.
Figure 2:
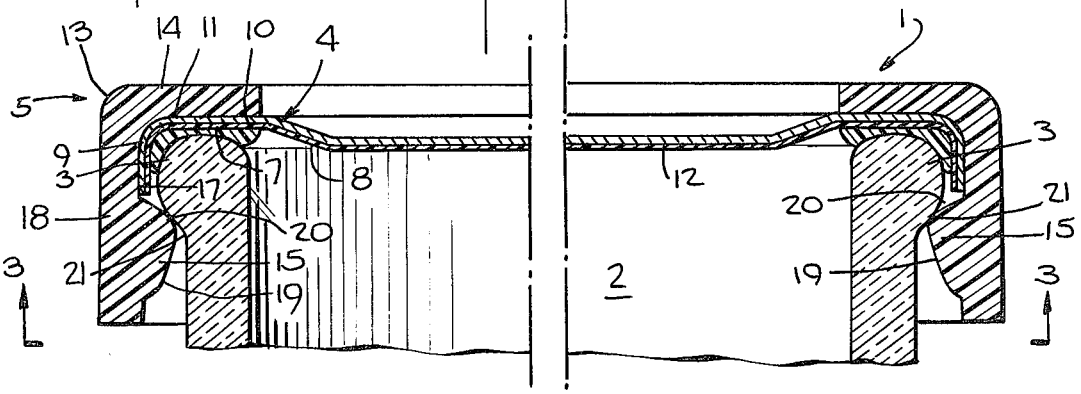
FIG. 2 is a vertical sectional view taken along line 2—2 on FIG. 1.

A preferred shaping for the plastic ring 5 is illustrated in FIGS. 1 and 2. The ring 5 includes a depending skirt portion 18 generally parallel to the container axis which is connected by a corner portion 13 to an annular radially inwardly extending partial cover portion 14. The upper portion of the skirt 18 together with the corner 13 and the cover portion 14 cooperate together with a container engaging bead 15 to form an inwardly directed channel 17 for receiving and for engaging the outer portion of the cover 4 including the skirt or wall portion 9. The channel 17 has a width corresponding generally to the height of the skirt portion 9 on the cap cover 4 so that the cover 4 may be firmly mounted and retained in the plastic ring 5.

The skirt 18 and the cover portion 14 of the plastic ring 5 are seen to be relatively thick to provide a form retaining ring. The cover portion 14 preferably extends inwardly to the outer end of the stacking panel wall 8 and slightly inwardly of the container rim 11.

Thus, when the cover 4 is snapped into position with its outer skirt 9 engaged by the above described channel 17, a composite closure results which may be handled as a unit during the closure cap shipping, feeding, and sealing operations typical for cap usage. FIG. 2, in particular, illustrates a preferred cross-sectional shape for the bead 15 which is provided on a preferred embodiment of the closure cap. In cross-section, the bead 15 has a lower guide portion 19 forming an acute angle with the vertical or the container axis for facilitating the downward press-on application of the closure caps 1 to the containers 2. The lower portion 19 of the bead 15 communicates with a container bead 3 engaging surface 20 which has only a slight angle with the horizontal or the plane of the container rim to assure a firm engagement with the inwardly slanted surface 21 of the container bead 3.

Figure 4:
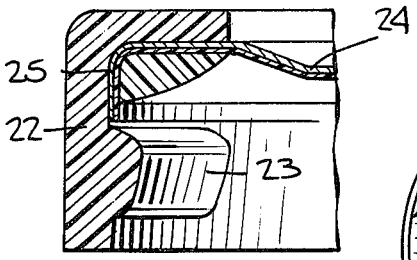
FIG. 4 is a fragmentary vertical sectional view of another embodiment of the closure cap.
Figure 5:
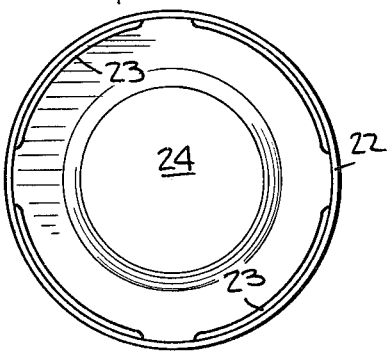
FIG. 5 is a bottom plan view of the closure cap of FIG. 4.

FIGS. 4 and 5 illustrate another form of a container engaging ring 22 which is similar to the ring 5 except that the container engaging means on the ring 22 are lugs 23. As illustrated in FIG. 5, these lugs 23 occupy relatively long arcs on the circumference of the plastic ring 22, for example, a major portion of a 90 degree arc. The spaced lugs 23 cooperate to form a cap cover 24 retaining channel 25 to lock the cover 24 in place in the ring 22.

Figure 6:
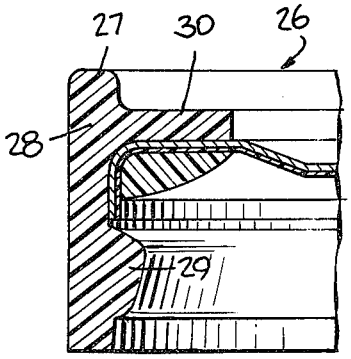

FIG. 6 illustrates an alternate embodiment in the form of a closure cap 26 having an upwardly extending stacking and protective flange 27 formed as an integral portion of the ring 28 along with lugs 29 and cover portion 30.

Figure 7:
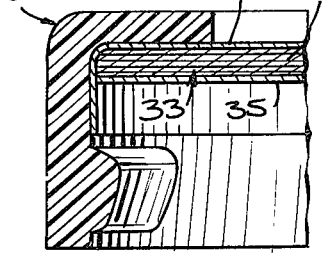
FIGS. 6, 7 and 8 are fragmentary vertical sectional views illustrating alternative embodiments of the gasket and plastic ring structure.

FIG. 7 illustrates an alternate embodiment where the closure cap 31 has a metal cover 32 with a flat top surface so that the cover 32 may receive a safety seal or other form of paper-board liner 33. The liner 33 illustrated in FIG. 7 comprises a relatively thick inner liner 34 having an air impervious sealing membrane 35 lightly fastened to its lower surface. This form of the closure cap is used to form a safety seal package where the membrane 35 is adhered to and remains attached to the container rim when the closure cap is first removed from the sealed package.

Figure 8:
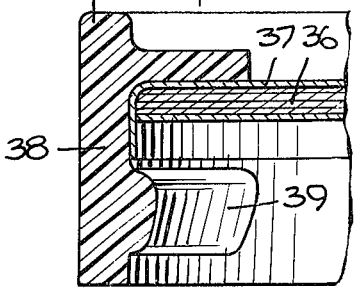

FIG. 8 illustrates a still further embodiment showing a paper-board liner 36 in the metal cover 37 where the plastic ring 38 has container engaging lugs 39 and has an upwardly extending stacking flange 40 of the general type described in connection with FIG. 6.

It will be seen that an improved composite pry-off closure cap has been described. The cap combines the advantages of a metal cover capable of providing a reliable vacuum seal with the advantages of an easily formed plastic ring as incorporated in the container engaging portion of the cap. The combined composite closure is tamperproof and inexpensive to manufacture and is also attractive. The metal cover affords a means of decorating the cap to provide trademarks or other indicia by way of lithography or other sheet metal decorative methods. The cap also is of a form which may be adapted for use with both flowed-in cap liners or alternatively with pulp board liners including safety seal liners.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. An improved composite closure cap for sealing a container having a radially outwardly projecting cap engaging bead at its rim comprising the combination of:

a molded plastic ring having an annular cover portion and a downwardly dependent skirt portion both of said portions being relatively rectangular in cross-section;

said cover portion and said skirt portion being coupled together by a corner portion;

inwardly projecting container engaging means on the said skirt portion for engaging the container bead having a generally horizontal container bead engaging portion at its top and a guide portion therebelow forming an acute angle with the vertical;

said cover portion, said corner portion, said skirt portion and said container engaging means cooperating to form an inwardly facing channel;

a circular metal cap cover positioned within said plastic ring having an outer depending skirt received within said channel having its lower edge positioned above said bead engaging portion of said container engaging means and having an outer annular top portion in engagement with the underside of the cover portion of said plastic ring;

the lower corner of said skirt comprising a generally rectangular portion in cross-section positioned to be spaced from the container; and a sealing gasket on the underside of said metal cap cover for engaging the container rim.

2. A composite closure cap as claimed in claim 1 in which said corner portion includes an upwardly extending circular stacking flange having a generally rectangular cross-section.

3. A composite closure cap as claimed in claim 1 in which said sealing gasket comprises a cut liner.

4. A composite closure cap as claimed in claim 1 in which said sealing gasket comprises a cut liner with a safety seal membrane positioned on the under surface of said liner.

5. A composite closure cap as claimed in claim 1 in which said container engaging means comprises a circular bead.

6. A composite closure cap as claimed in claim 1 in which said container engaging means comprises a plurality of arcuate lug members.

7. An improved composite closure cap for sealing a container having a radially outwardly projecting cap engaging circular bead with a rounded convex cross-section at its rim comprising the combination of:

a molded plastic ring having an annular cover portion and a downwardly depending skirt portion;

said cover portion and said skirt portion being relatively rigid and both being generally rectangular in cross-section;

said cover portion and said skirt portion being coupled together by a corner portion;

radially inwardly projecting holding means on the inner surface of said plastic ring for engaging a lower portion of the cap engaging bead on the container;

said holding means having a rounded convex cross-section including an upper container bead engaging surface extending radially inwardly and downwardly from said inner ring surface at a slight angle to the horizontal and then curving downwardly and outwardly from its radially innermost portion at an acute angle to the vertical forming a lower guide portion;

said cover portion, said corner portion, said skirt portion and said container engaging means on said plastic ring cooperating to form an inwardly facing channel;

a circular metal cap cover positioned within said plastic ring having an outer depending skirt received within said channel with the lower skirt edge positioned above the radially outermost portion of the bead engaging surface of said holding means and having an outer annular top portion in engagement with the underside of the cover portion of said plastic ring;

the lower portion of said skirt portion positioned to be spaced from said container; and a sealing gasket on the underside of said metal cap cover for engaging the container rim.

* * * * *